US009080787B2

(12) United States Patent
Hofmann et al.

(10) Patent No.: US 9,080,787 B2
(45) Date of Patent: Jul. 14, 2015

(54) SUCTION CHAMBER

(75) Inventors: Daniel Henri Bedatty Hofmann, Joinville (BR); Viviane Cassol Marques, Johnville (BR); Claudio de Pellegrini, Joinville (BR)

(73) Assignee: Whirlpool S.A., Sao Paulo, SP (BR)

( * ) Notice: Subject to any disclaimer, the term of this patent is extended or adjusted under 35 U.S.C. 154(b) by 0 days.

(21) Appl. No.: 14/235,252

(22) PCT Filed: Jul. 17, 2012

(86) PCT No.: PCT/BR2012/000244

§ 371 (c)(1),
(2), (4) Date: Jun. 3, 2014

(87) PCT Pub. No.: WO2013/016790

PCT Pub. Date: Feb. 7, 2013

(65) Prior Publication Data

US 2014/0326533 A1 Nov. 6, 2014

(30) Foreign Application Priority Data

Jul. 29, 2011 (BR) ..... 1103315

(51) Int. Cl.
*F24F 13/24* (2006.01)
*F04B 39/00* (2006.01)

(52) U.S. Cl.
CPC ..... *F24F 13/24* (2013.01); *F04B 39/0055* (2013.01); *F04B 39/0061* (2013.01)

(58) Field of Classification Search
CPC ..... F24F 13/24
USPC ..... 181/224, 259
See application file for complete search history.

(56) References Cited

U.S. PATENT DOCUMENTS 4,109,751 A 8/1978 Kabele
4,759,693 A 7/1988 Outzen
(Continued)

FOREIGN PATENT DOCUMENTS

DE 3622996 A1 2/1988
DE 10117072 4/2002
(Continued)

OTHER PUBLICATIONS

International Search Report for International Application No. PCT/BR2012/000244 mailed Nov. 6, 2012.

*Primary Examiner* — Forrest M Phillips
(74) *Attorney, Agent, or Firm* — Brian J. Colandreo; Jeffrey T. Placker; Holland & Knight LLP

(57) ABSTRACT

The present invention refers to a suction chamber having two volume parts which utilizes the principle of wave cancellation, by reversing the phase thereof, as a way of attenuating the noise, whose configuration presents a simple, effective, economical and affordable constructive process. It is composed by a body (1) that is subdivided into at least two superposed compartments (2) and (3); at least two inlet passages (4) and (5) that interconnect the external region of the body (1) to the internal compartments (2) and (3); at least one interconnecting passage (6) between the compartments (2 and 3), and one outlet passage (7) that interconnects the internal region of the lower compartment (3) of the body (1) to the compressor cavity (not shown), wherein the inlet passages comprise one passage (4) that extends from the external region of the body (1) up to the interior of the upper compartment (2) and a passage (5) that extends from the external region of the body (1) up to the interior of the lower compartment (3). Furthermore, the interconnecting passage (6) has a bigger cross section than the cross section of the inlet passages (4) and (5).

7 Claims, 2 Drawing Sheets

(56) References Cited

U.S. PATENT DOCUMENTS

Figure 1:
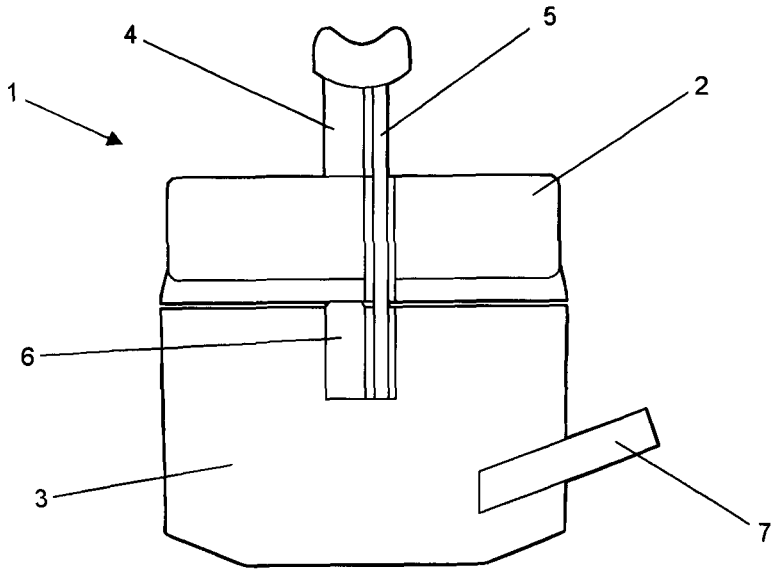

| | | | | |
|---|---|---|---|---|
| 5,125,241 | A | 6/1992 | Nakanishi et al. | |
| 5,594,217 | A * | 1/1997 | LeQuire | 181/235 |
| 6,845,843 | B2 * | 1/2005 | Svendsen et al. | 181/262 |
| 7,959,416 | B2 * | 6/2011 | Bosco et al. | 417/312 |
| 8,246,320 | B2 * | 8/2012 | Park et al. | 417/312 |
| 8,584,795 | B1 * | 11/2013 | Buckner | 181/224 |
| 2002/0035844 | A1 | 3/2002 | Lee et al. | |
| 2002/0090305 | A1 | 7/2002 | Myung et al. | |
| 2003/0221905 | A1 * | 12/2003 | Xia | 181/224 |
| 2014/0326533 | A1 * | 11/2014 | Hofmann et al. | 181/224 |

FOREIGN PATENT DOCUMENTS

| | | | |
|---|---|---|---|
| EP | 0 027 311 | A1 | 4/1981 |
| KR | 960003388 | B1 | 3/1996 |
| WO | 2006/116830 | A1 | 11/2006 |
| WO | 2009/152594 | A1 | 12/2009 |

* cited by examiner

SUCTION CHAMBER

RELATED APPLICATIONS

The subject application is a U.S. National Stage Application of International Application No. PCT/BR2012/000244, filed on 17 Jul. 2012, which claims the priority of Brazil Patent Application No.: PI1103315-0, filed on 29 Jul. 2011, the contents of which are herein incorporated by reference in its entirety.

FIELD OF THE INVENTION

The present invention refers to a suction chamber having two volume parts which utilizes the principle of sound wave cancellation as a way of attenuating the noise, whose configuration presents a simple, effective, economical and affordable constructive process.

BACKGROUND OF THE INVENTION

As already known in the prior art, cooling systems function with coolant gas compressors that make a lot of noise while they are operating, rendering the search for ways of attenuating the noise a constant work.

With basis on the fundamentals of acoustics, it is known that the sound can be defined as a very fast pressure changes which travels in the form of waves in an elastic medium and, generally, it is caused by the vibration of an elastic body, which generates a corresponding pressure change in the surrounding medium. The sound can be represented by a sine wave, described as a circular movement which travels along an axle—which may represent a distance or time, for example—and the relation of such movement to a reference point is named phase.

The sound wave cancellation occurs when two waves having the same frequency, despite a phase difference of 180 degrees, reach one another at a certain position. When this phenomenon occurs said two waves are cancelled, reducing, then, the noise at this certain frequency. Therefore, if two waves having the same frequency, being 180 degrees out of phase, reach one another, said waves will be cancelled and the total cancellation will occur when the amplitude of the waves are equal. On the contrary, the waves will be only partially cancelled.

The object of document U.S. Pat. No. 5,125,241 is based on the principle of sound wave cancellation for attenuating the noise produced by the compressor involving, however, a plurality of electrical and electronic components—such as sensors, microphones and loudspeakers, for example—which renders the constructive system extremely complex and, consequently, expensive.

Document KR960003388 reveals a main inlet pipe folded in a specific angle and provided with a plurality of openings, which settles, in its interior, a second pipe for attenuating the sound by utilizing the concept of phase cancellation. It is noted, however, that this configuration is also significantly complex, being also expensive, besides subjecting the apparatus to the occurrence of problems that may demand a frequent maintenance.

OBJECTIVES OF THE INVENTION

Therefore, one of the objectives of the present invention is the provision of a suction chamber with two volume parts utilizing the principle of sound wave cancellation which, by the utilization of simple and economical constructive solutions, promotes a considerable reduction of noise level that is produced by the system.

A second objective of the present invention is the provision of a suction chamber that is subdivided into at least two volume parts so as to promote a greater effectiveness in the sound wave cancellation and, consequently, in the attenuation of noise.

Another objective of the present invention is the provision of a suction chamber whose compartments are provided with pipes of different diameters so as the energy/amplitude of the wave transmitted through both pipes are equivalent and, therefore, enabling a more efficient wave cancellation.

SUMMARY OF THE INVENTION

The present invention achieves the above-mentioned objectives by means of a suction chamber that comprises a body that is subdivided into at least two superposed compartments, at least two inlet passages that interconnect the external region of the body to the internal compartments, at least one interconnecting passage between the compartments, and one outlet passage that interconnects the internal region of the lower compartment of the body to the compressor cavity.

In a preferred embodiment of the invention, said inlet passages comprise one pipe that extends from the external region of the body up to the interior of the upper compartment, and one inlet pipe that extends from the external region of the body up to the interior of the lower compartment.

According to a preferred embodiment of the present invention, said inlet passages present distinct cross sections and, preferably, the inlet passage of the upper compartment has a bigger cross section or diameter than the cross section or diameter of the inlet passage of the lower compartment.

The inlet passage of the lower compartment and the interconnecting passage between the compartments are adjacent to each other, with lower ends placed in a coincident level in the interior of the lower compartment.

In the preferred embodiment of the present invention, the interconnecting passage and the inlet passage of the lower compartment have distinct cross sections, wherein the interconnecting passage has the biggest cross section.

SHORT DESCRIPTION OF THE DRAWINGS

The figures show:

FIG. 1—illustrates a top view of the suction chamber with two volume parts, which was assembled in accordance with one of the preferred embodiments of the present invention.

Figure 2:
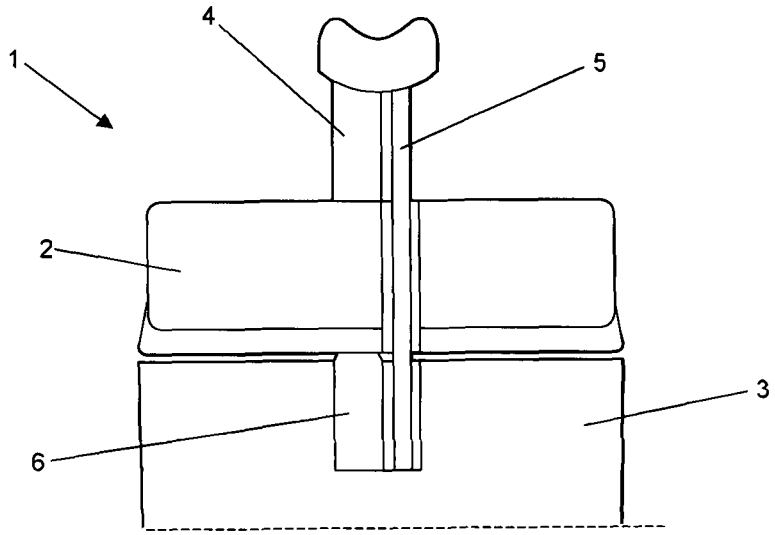

FIG. 2—illustrates a view in extended detail of the upper region of the equipment of FIG. 1.

Figure 3:
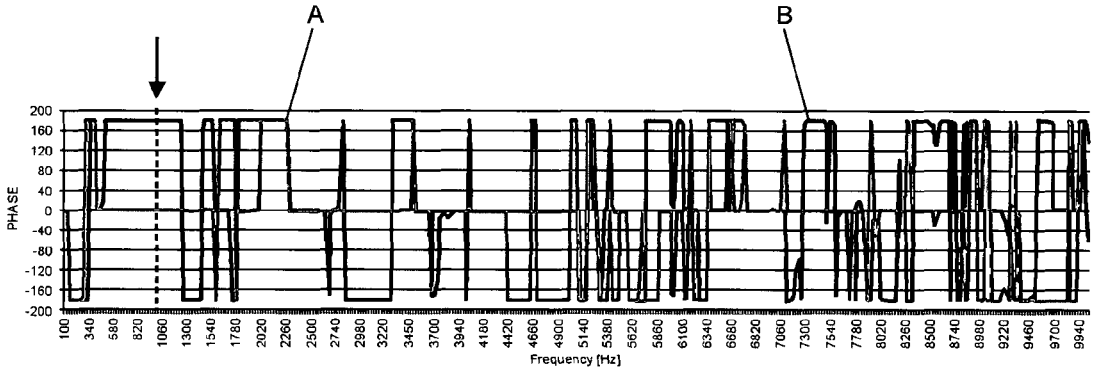

FIG. 3—illustrates a chart that indicates the difference between the phase absorbed by a sensor installed in the lower end of the inlet passage of the lower chamber (A) and the values absorbed by a sensor installed in the lower end of the interconnecting passage between the upper and lower compartments (B).

DETAILED DESCRIPTION OF THE INVENTION

The invention will be described, in detail, as follows with basis on the examples represented in the appended drawings.

As illustrated in FIG. 1, the suction chamber with two volume parts utilizing the principle of phase cancellation, assembled in accordance with a preferred embodiment of the present invention, comprises a body (1) that is subdivided into at least two superposed compartments 2 and 3, each compartment comprising a corresponding inlet passage—passage 4 extends from the external region of the body 1 up to the interior of the upper compartment 2, and the inlet passage 5 extends from the external region of the body 1 up to the interior of the lower compartment 3.

Compartments 2 and 3 interconnect to each other by means of an interconnecting passage 6 which, preferably, extends from the lower surface of the upper compartment to the central region of the lower compartment 3.

The cited body 1 further comprises an outlet passage 7 which connects the internal region of the lower compartment 3 of the body 1 to the compressor cavity (not shown).

In the preferred embodiment of the present invention, said passages 4 and 5 present distinct cross sections, wherein the better results are achieved when the cross section of passage 4 is bigger than the cross section of passage 5.

The interconnecting passage 6 between compartments 2 and 3 also presents a bigger cross section or diameter than the cross section or diameter of the inlet passage of the lower compartment 3.

Such difference in the cross section of the passages renders the energy transmitted through both ways—from the external region to the lower compartment 3 and from the upper compartment to the lower compartment 3—equivalent, although not simultaneous, so that the difference of phase between both promotes the attenuation—and, depending on the frequency intervals, even the minimization—of the noise levels produced by the compressor.

Such result is also achieved by the arrangement of the intermediate pipe 6 and the inlet pipe 5 of the lower compartment 3, which remain adjacent to each other and with lower ends placed in a coincident level in the interior of the compartment 3.

The results of the preferred embodiment of the present invention could be confirmed by a simulation based on finite elements method, which resulted in a representative chart of the difference of phase in the outlet of both pipes—intermediate pipe 6 and inlet pipe 5 of the lower compartment 3—illustrated in FIG. 3.

For its reproduction, sensors were placed in the lower ends of the interconnecting passage 6 and inlet passage 5 of the lower compartment 3. Such chart enables to observe that, for several frequency intervals, the curves related to the interconnecting passage 6 and inlet passage 5 of the lower compartment 3 are different, generating points in which the phase of a curve is placed symmetrically opposed to the phase of the other curve, resulting in the minimization of the sound produced by means of the wave cancellation principle.

It shall be emphasized that such results are achieved without including any electric or electronic device or any additional equipment, since the proper positioning and diameter of the parts causes the natural occurrence of the phase cancellation which operates with the assembly described herein.

It shall be further detached that, although the present specification focus on the preferred embodiments of the present invention, it is understood that occasional omissions, substitutions, and changes can be done by a skilled in the art, without deviating from the spirit and scope of the intended protection. It is also foreseen that all combinations of the elements that have the same function substantially by the same manner to achieve the same results are within the scope of the invention. Substitutions of elements of a described embodiment by others are also completely foreseen and considered.

It shall be understood, however, that the description provided with basis on the above-mentioned figures only refers to some possible embodiments for the system of the present invention, wherein the real scope of the object of the instant invention is defined in the appended claims.

The invention claimed is:

1. A suction chamber characterized in that it comprises:

a body that is subdivided into at least two superposed compartments;

at least two inlet passages that interconnect an external region of the body to an internal region of a respective one of the compartments;

at least one interconnecting passage between the compartments, and one outlet passage that interconnects the internal region of a first compartment of the body to a compressor cavity;

wherein at least one inlet passage has a distinct cross section from at least one of the other inlet passage and the interconnecting passage to promote noise level attenuation via sound wave cancellation.

2. The suction chamber, in accordance with claim 1, characterized in that said inlet passages comprise:

one inlet passage that extends from the external region of the body up to the internal region of an upper compartment, and one inlet passage that extends from the external region of the body up to the internal region of a lower compartment.

3. The suction chamber, in accordance with claim 1 or 2, characterized in that said inlet passages present distinct cross sections.

4. The suction chamber, in accordance with claim 3, characterized in that said inlet passage extending to the upper compartment has a bigger cross section than the cross section of the inlet passage extending to the lower compartment.

5. The suction chamber, in accordance with claim 1, characterized in that said inlet passage extending to the lower compartment and the interconnecting passage are adjacent to each other, with lower ends placed in a coincident level in the internal region of the lower compartment.

6. The suction chamber, in accordance with claim 1 or 5, characterized in that said interconnecting passage between the compartments and the inlet passage to the lower compartment have distinct cross sections.

7. The suction chamber, in accordance with claim 6, characterized in that said interconnecting passage has a bigger cross section than the cross section of the inlet passage to the lower compartment.

* * * * *